US005109564A

United States Patent [19]

Horvath

[11] Patent Number: 5,109,564

[45] Date of Patent: May 5, 1992

[54] MANUAL VALVE CLEANER FOR REMOVING DEPOSITS FROM INTAKE AND OUTTAKE VALVES OF INTERNAL COMBUSTION ENGINES

[76] Inventor: Robert J. Horvath, 310 Homewood Dr., Libertyville, Ill. 60048

[21] Appl. No.: 618,976

[22] Filed: Nov. 28, 1990

[51] Int. Cl.[5] ..... A47L 25/00

[52] U.S. Cl. ..... 15/236.06; 15/104.011; 15/104.04; 29/81.11; 30/172

[58] Field of Search ..... 15/104.011, 104.04, 15/236.05-236.08, 236.10; 30/172; 408/204; 29/81.05, 81.11, 81.13

[56] References Cited

U.S. PATENT DOCUMENTS

| | | | |
|---|---|---|---|
| 1,774,567 | 9/1930 | Raphael | 15/236.06 |
| 2,204,516 | 6/1940 | Stone | 15/236.06 |
| 2,593,799 | 4/1952 | Russell | 15/104.04 |
| 2,748,410 | 6/1956 | Chapman | 15/236.08 |
| 3,023,754 | 3/1962 | Cuchiara | 15/236.06 |

FOREIGN PATENT DOCUMENTS

| | | | |
|---|---|---|---|
| 62923 | 5/1927 | Sweden | 15/236.06 |

*Primary Examiner*—Philip R. Coe
*Assistant Examiner*—Mark Spisich
*Attorney, Agent, or Firm*—Malin, Haley, McHale, DiMaggio & Crosby

[57] ABSTRACT

The invention is directed to a apparatus that facilitates the removal of excess combustion deposits from combustion chamber valves of conventional internal combustion engines. The apparatus has a handle at one end of a hollow cylinder and a plurality of resilient blades coupled to the opposite end. The device is placed over the valve stem of a valve to be cleaned and when a force is applied to the handle, the blades scrape the angular surface of the valve neck clean with the blades following the contour of the valve neck portion. When the force is removed from the handle the blades return to their original position.

4 Claims, 1 Drawing Sheet

MANUAL VALVE CLEANER FOR REMOVING DEPOSITS FROM INTAKE AND OUTTAKE VALVES OF INTERNAL COMBUSTION ENGINES

FIELD OF THE INVENTION

This invention relates generally to the engine refurbishing market, and more particular, to a new and improved apparatus or device that facilitates the removal of combustion deposits from combustion chamber valves when disassembled from the engine.

BACKGROUND OF THE INVENTION

The present invention relates to an apparatus or device for cleaning combustion chamber valves of conventional internal combustion engines.

Internal combustion engines are capable of converting a wide variety of petroleum products such as gasoline, kerosene, fuel oil, liquefied petroleum gas, and so forth into mechanical energy. Due to convenience of supply, the dominant petroleum product used for internal combustion engines is gasoline. Use of gasoline leads to combustion deposits due to inherent impurities of the petroleum product. For example, a common use of the internal combustion engine is for powering an automobile. A typical automobile utilizes a reciprocating piston, four cycle, water-cooled, poppet valve, gasoline engine. The engine may be air or water cooled and employ from one to sixteen cylinders with two or four valves per cylinder.

The valves are within the cylinder portion of the engine where a sequence or events taxes place to convert gasoline into mechanical power. Valves are used to control intake and exhaust of the cylinder while a reciprocating piston travels the length of the cylinder in conjunction with the valve operation. An intake stroke occurs when the piston performs a downward stroke while an intake valve is open. The downward motion of the piston draws an explosive mixture of gas/air past the intake valve and into the cylinder. A compression stroke occurs when the previously opened intake valve is closed and the piston rises to compress the gas/air mixture. At the upper limit of the piston movement the mixture is ignited resulting in an explosion which forces the piston downward, or power stroke. A fourth stoke, known as the exhaust stroke, utilizes an exhaust valve to expel the spent mixture from the cylinder. This sequence is commonly referred to as a four-cycle rotation.

These valves, whether sleeve, rotary, slide or poppet are subjected to explosive forces best described as brutal. Valves are momentarily exposed to a burning mixture whose temperature may approach 5000 degrees Fahrenheit. The valves, unlike the piston which is cooled by oil or the cylinder which is cooled by water, cannot readily be cooled. Cooling of the valves is usually limited to heat dissipation through the valve stem and the amount of time the time the valve is in contact with a valve seat. If the engine operates at 3000 rpm's then the valve is lifted off the seat 1500 times per minute. Valve technology includes face coatings, head coatings, aluminizing and hollow stems filled with metallic sodium to help the valve cooling operation.

Over a period of time this harsh operating environment may lead to the premature destruction of the mating surfaces between the valves and valve seats. As this mating surface degrades unburnt gases can create a residual of carbon deposits that adhere to an angular neck area of the valve located between the valve stem and valve face. Once these deposits begin the temperature bakes the deposits on accelerating the degradation of the mating surfaces until a loss of cylinder compression occurs causing the engine to run poorly.

The present invention is directed to the situation wherein the valves no longer seat correctly requiring resurfacing of the valves. During the valve refurbishing process the valve is placed on a refacing machine, however, before the valve is placed on a resurfacing machine the carbon deposits that adhered to the valve must be removed to prevent clogging of the facing wheel or additional problems if reinstalled on the engine.

Heretofore, it has been the practice of service shop repair men to scrape the excess carbon from the valve. Known removal techniques include the use of a pocket knife or other sharp object. A major problem with this technique arises from the valve manufactures use of high technology steels such martensitic, austenitic steels or superalloys for valve construction and the type of steel used is not determinable by the naked eye. A knife or other sharp object that is not specifically designed for the carbon removal process can damage the valve beyond repair. If a cutting tool is softer than the valve, the danger of the tool shattering causing risk of injury increases.

Another method of carbon removal is the insertion of the valve into a dip tank of chemical to dissolve the carbon. Since a normal eight cylinder car employs sixteen valves engine and a high performance eight cylinder engine may have thirty two valves, the practice of using a dip tank is not economical. The volume of chemical is unpredictable for each valve soaking dilutes the chemical resulting in frequent disposal of a hazardous waste. This method of carbon removal is also time consuming for the valves must sit in the solvent and depending on the strength of the solvent, remain in the dip until the carbon is dissolved. Further, valve marking is difficult when numerous valves are placed in chemical tank. The hazards to the environment and service personal are evident by chemical soaking.

Yet another practice is to use a rotating wire brush to remove the carbon deposits. Depending on the amount of carbon deposits this method can be time consuming for the carbon must be taken down by abrasion. In addition, the abrasion may break off large deposits or brush wires, either of which becomes a projectile injurious to operating personnel.

The problems of removing carbon deposits quickly and safely are those which have long plagued engine rebuilders and valve refurbishers. While extensive efforts have been made toward effectively and simply resolving this problem, no satisfactory solution has heretofore been provided. It is, therefore, to the effective resolution of this problem that the present invention is directed.

SUMMARY OF THE INVENTION

It is the principal feature of the present invention to provide a means of safely removing the excess carbon on the angular neck portions of a valve. The apparatus or device is relatively simple utilizing a construction that can be used safely, without harm to the environment, while providing a highly effective method of removing carbon deposits from valves.

The preferred embodiment of the apparatus is in its use as a hand tool. The apparatus is a hollow cylinder with an aperture extending longitudinally starting with an opening at one end of the hollow cylinder having a handle at the opposite end. A plurality of resilient blades are coupled to the open end of the hollow cylinder. To operate, the device is held by the handle and the aperture of the hollow cylinder placed over a valve stem of a valve to be cleaned. The aperture acts as a guide-way centering the blades, coupled to the hollow cylinder, around the stem permitting uniform blade contact at the angular neck portion of the valve. As a force is applied to the handle the blades scrape the angular surface of the valve neck clean. Since the carbon deposit is inherently a hardened substance it is most advantageous to separate the carbon at the point of metal adhesion which the cutting blade follows. As the angular surface of the valve increases in width the blades follow the contour of the neck portion. When the force is removed from the handle the resilient blades return to their original position. If additional carbon deposits are to be removed the apparatus is lowered again over the valve.

It is an important feature of the present invention that the blades, such as carbon steel, used for carbon removal are designed to bend with the curve of a valve creating a situation whereby the blade is forced closer to the valve material as the width of the valve neck increases. The invention finds particular utility in its ability to remove a majority of carbon deposits with a single application of the device.

An object of the invention is to provide a hand held valve cleaning apparatus formed from a hollow cylinder having a plurality of resilient blades couple to the hollow cylinder by means of a plurality of axially spaced apart mounting pins extending obliquely from and attached permanently to the hollow cylinder.

It is a related object of the invention that a means for securing resilient blades to the mounting pins is by use of an elastic band or a hose clamp.

Still another object of the invention is to use a spring to assist in lifting the device off the valve when a force is removed from the device.

Another related feature of the invention is the use of the invention with a leverage arm or rotating valve plate in place of a handle for larger valves or industrial applications.

Still another feature of the invention is its use on wide range of valve sizes by use of an appropriately sized aperture.

Other and further objects, features, and advantages of the invention will become evident upon the reading of the following specification taken in conjunction with the drawing.

BRIEF DESCRIPTION OF THE DRAWINGS

The invention will be more readily understood with reference to the accompanying drawings, wherein.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure. The aims and objects of the invention are accomplished by providing a device that effectively removes excess carbon deposits on a valve.

Figure 1:
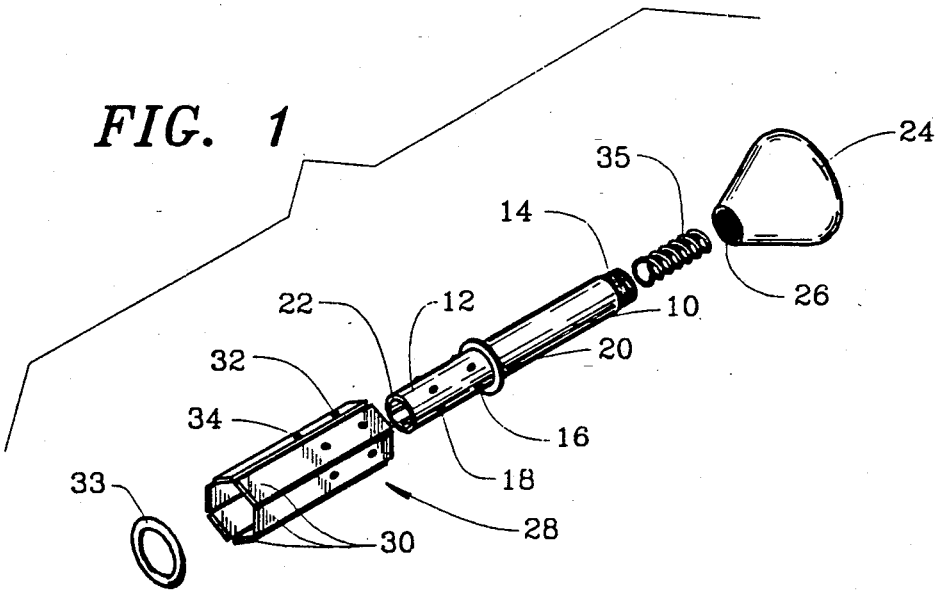
FIG. 1 is a perspective view showing the Valve Cleaner with its handle, hollow cylinder, and blades separated.

Referring to the drawings in more detail, and more particularly to FIG. 1, there is shown a preferred embodiment of the invention provided for illustrative purpose and not to be construed in any limiting sense. My valve cleaner apparatus is comprised of three basic components that couple together to form a single tool. A hollow cylinder 10 is constructed of one piece metal or plastic between 3 and 8 inches with an aperture 12 between 0.250 and 0.525 inches extending longitudinally in the cylinder. For manufacturing simplicity the length of the aperture extends through the hollow cylinder. A male coupler 14 is formed by threading the hollow cylinder for coupling to leverage arms or handle's. The opposite end of the hollow cylinder is modified to provide a means for coupling a plurality of resilient cutting blades to the cylinder. A set of top blade mounting pins 16 extend obliquely from and are permanently attached to the hollow cylinder and a bottom set of blade mounting pins 18 also extend obliquely from and attach to the hollow cylinder. A blade stop ring 20 is located between the end 14 of the hollow cylinder and the top mounting pins 16. The function of the pins and stop ring will be further explained in the description of the cutting blades.

The leverage arm or handle 24 is used to provide a contoured and comfortable means for operating the apparatus. The handle is constructed from a single piece of material with a female coupler 26 placed within or cut out of the handle. The male couple 14 and the female coupler 26 are threaded together to form a finished and aesthetically pleasing tool end as well as concealing the coupling. It should be understood that the handle and hollow cylinder can be formed from a socket, weldment, or a single piece of material.

The cutting portion 28 consists of a plurality of resilient interchangeable blades 30 between 0.5 inches and 5 inches in length axially spaced apart. Each blade has an upper pin coupling holes 32 which fits over one of the top hollow cylinder mounting pins 16 and each blade has a lower pin coupling holes 34 which fits over one of the bottom hollow cylinder mounting pins 18.

Figure 2:
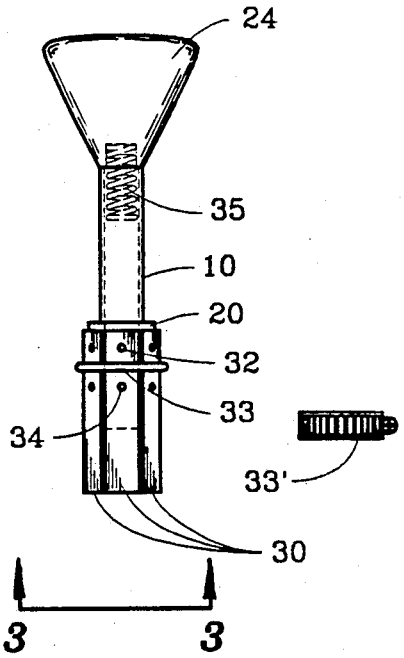
FIG. 2 is a perspective view showing the manner of attaching the blades to the hollow cylinder.

Now referring to FIG. 2 the blades 30 are shown with their upper pin coupling holes 32 and lower pin 34 coupling holes placed over the top mounting pins 16 and bottom mounting pins 18 of the hollow cylinder 10. To secure the blades in position a reusable clamp 32 is placed between the top pins 16 and bottom pins 18. The blade stop 20 previously described as being permanently affixed to the hollow cylinder is shown providing a safety stop to prevent the blade openings 32,34 from shearing off in the event of excess force being applied to the handle 24 forcing an upward shearing action by the coupling holes.

The preferred type of clamp 32 is made from an elastic band such as rubber which allows the use of rigid cutting blades. As the cutting edge 34 follows the contour of an angular valve the elastic band provides sufficient flexibility to allow the blades to rise up on the hollow cylinder mounting pins 18 and provides the resiliency to return the blades back to their original position. Blade replacement is preformed by sliding the clamp 34 past the hollow cylinder pins 16 toward the handle 24, allowing the blades to be removed from the hollow cylinder pins. Operation is restoring by locating the clamp back to the area between the hollow cylinder pins 16 and 18. The use of a elastic clamp is limited to smaller valves wherein the displacement of the cutting edge will not rise over the size of the hollow cylinder pins.

A variation of the clamp 32 for larger valves or when bendable blades are employed is the use of a conventional hose clamp 33. The hose clamp 33 prevents the blades 30 from lifting on the hollow cylinder pins 18. When the cutting edge 34 of the blade is forced to follow the contour of the valve, the portion of the blade between the hose clamp 33 and the cutting edge will bend while the force is applied and upon removal will return back to its original position. Replacement of the blades requires the complete removal of the hose clamp 33 while the blades are exchanged. It should be obvious to those skilled in the art that blade attachment can also be made permanent thereby eliminating the use of the hollow cylinder pins, stop ring, clamp and deemed to be within the scope of this invention.

A spring 35 can be placed between within the hollow cylinder which is compressed by a downward force during use of the apparatus and when the force is removed the spring 35 decompresses lifting the apparatus, thus the blades, away from the valve.

Figure 3:
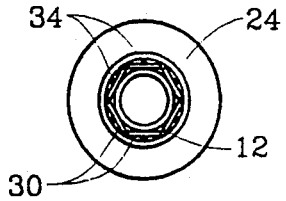
FIG. 3 is a perspective view of the bottom of the Valve Cleaner showing the axial spacing of the cutting blades.

FIG. 3 is the bottom view of my invention showing the cutting edge of the blades 34 surrounding the opening to the aperture 12 of the hollow cylinder. The diameter of the aperture is between 0.250 inches and 0.525 inches allowing for the insertion of valve stems commonly manufactured. The diameter may be increased to accommodate larger valves or decreased for a particular size valve. The blade holder 32 encompasses the blades.

Figure 4:
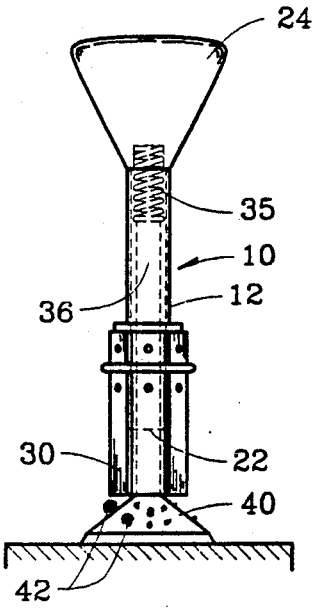
FIG. 4 is a perspective view showing the Valve Cleaner in the process of cutting the carbon deposits from a valve.

Now referring to FIG. 4 the apparatus is shown with a valve stem 36 inserted into the aperture 12 of the hollow cylinder 10 which forms a guide-way for the stem. As a force 38 is applied to the handle 24 thereby compressing the optional spring 35 and compelling the resilient, yieldable and springy blades 30 to traverse the angular portion of valve 40 resulting in the cutting of carbon deposits 42 from the valve 40. The lower end of the hollow cylinder is strategically positioned to only contact the angular portion of the valve 40 to prevent over extension of the cutting edge 34 thereby preventing damage to the resiliency of the blades. If incomplete carbon removal occurs the force 38 is removed allowing the blades to return to their original position and the force reapplied to perform additional cutting action. If the optional spring 35 is installed, upon removal of force 38 the spring 35 decompresses allowing lifting of the blades from the valve by release of spring tension.

It will be apparent that modifications in accordance with the present invention can be made by those skilled in the art without departing from the spirit thereof and it is equally apparent that the assembly involving the application of utensil and attachment strap may be rearranged in order to accomplish this assembly without departing from the scope of the invention. This includes the employment of clasping members in combinations other than those described and illustrated by the drawings.

It will be obvious to those skilled in the art that various changes may be made without departing from the scope of the invention and the invention is not to be considered limited to what is shown in the drawings and described in the specification.

What I claim as new and desire to secure by Letters Patent of the United States is:

1. A cleaning apparatus for removing deposits from intake and outtake valves internal combustion engines, comprising:

a handle;

a cylinder forming an aperture having a first end and a second end, the first end of said cylinder coupled to said handle, the second end of said cylinder employing a plurality of upper and lower axially spaced apart mounting pins extending obliquely from and attached permanently to said cylinder;

a plurality of flexible rectilinear cutting blades each having four free edge and a first and second surface face, each blade having a length and a width, one of the edges being a cutting edge projecting beneath said second end of said cylinder, each cutting blade having at least one upper coupling hole and at least one lower coupling hole conforming to said mounting pins for placement over said mounting pins;

a band removably attached for securing said blades to said cylinder; and a spring releasably secured within the aperture;

whereby said upper and lower coupling holes on the first surface face of said blades are placed over said upper and lower mounting pins respectfully of said cylinder, said blades secured by placement of said band over the second surface face between the upper and lower pins extending through the upper and lower coupling holes, whereby the aperture of said cylinder is placed over a valve stem having a size less than the aperture and upon a force being applied to said handle said spring is compressed and said cutting edges of said blades uniformly contact the angular neck portion of the valve thereby removing deposits adhering to the valve and upon removal of the force from said handle said spring removes said blades from the valve.

2. The apparatus according to claim 1 wherein said band is further defined as one piece elastic plastic with an inner diameter equal to or less than the outer diameter of said cylinder for securing said blades to said cylinder.

3. The apparatus according to claim 1 wherein said band is a conventional metal hose clamp for securing said blades to said cylinder.

4. The apparatus according to claim 1 wherein the aperture of said hollow cylinder has an inner diameter greater than the outer diameter, respectively, of said valve stem of said internal combustion valve.

* * * * *